US005605194A

United States Patent [19]

Smith

[11] Patent Number: 5,605,194

[45] Date of Patent: Feb. 25, 1997

[54] INDEPENDENT SCREWED WELLHEAD WITH HIGH PRESSURE CAPABILITY AND METHOD

[75] Inventor: Leslie D. Smith, Fritch, Tex.

[73] Assignee: J. M. Huber Corporation, Tomball, Tex.

[21] Appl. No.: 492,350

[22] Filed: Jun. 19, 1995

[51] Int. Cl.[6] ..... E21B 33/04

[52] U.S. Cl. ..... 166/382; 166/348; 166/368; 285/175

[58] Field of Search ..... 166/348, 382, 166/368, 360, 379; 285/175

[56] References Cited

U.S. PATENT DOCUMENTS

| | | | |
|---|---|---|---|
| 3,247,914 | 4/1966 | Slack | 166/368 X |
| 3,955,623 | 5/1976 | Aumann | 166/340 |
| 4,550,782 | 11/1985 | Lawson | 166/382 |
| 4,552,213 | 11/1985 | Boyd et al. | 166/382 X |
| 5,028,079 | 7/1991 | Smith et al. . | |
| 5,080,174 | 1/1992 | Hynes | 166/382 |
| 5,240,081 | 8/1993 | Milberger et al. | 166/368 X |
| 5,341,885 | 8/1994 | Bridges | 166/382 |
| 5,439,061 | 8/1995 | Brammer et al. | 166/368 |
| 5,492,373 | 2/1996 | Smith | 285/175 |

OTHER PUBLICATIONS

Huber Drawing No. 7805 (dated Sep. 28, 1987).

*Primary Examiner*—Frank Tsay
*Attorney, Agent, or Firm*—Browning Bushman

[57] ABSTRACT

An independent screwed wellhead apparatus and method provide for connecting a high pressure casing nipple (34) to internal threads (36) disposed along the bore (38) of the wellhead body (12) to temporarily increase the working pressure capability of the wellhead body (12). The internal threads (36) are supported by a thick wall (44) of the wellhead body (12) disposed in a lower end (13) of the wellhead body (12). The lower end (13) of the wellhead body (12) has a higher working pressure capability than the upper end (19) of the wellhead body (12). The high pressure casing nipple (34) temporarily isolates the upper end (19) from the higher pressure.

20 Claims, 3 Drawing Sheets

INDEPENDENT SCREWED WELLHEAD WITH HIGH PRESSURE CAPABILITY AND METHOD

FIELD OF THE INVENTION

The present invention relates generally to wellhead assemblies and, more particularly, to apparatus and methods for temporarily providing high pressure capability for an independent screwed wellhead.

DESCRIPTION OF THE BACKGROUND

A wellhead may be classified by the American Petroleum Institute (API) as an independent screwed wellhead according to features discussed in the published Specification 6A. Generally, an independent screwed wellhead has an "independently" secured wellhead body, such as a casing head or a tubing head, for each tubular string disposed within the wellbore. The pressure within the casing is temporarily controlled by a blowout preventer (BOP) conventionally provided above the wellhead. The tubing head may be "independently" secured to a respective tubular string, and is not directly flanged or similarly connected to the casing head. Each independent wellhead body is secured to a respective tubular string, and a smaller diameter production tubular string generally extends through the wellhead body.

More specifically, an independent screwed wellhead may utilize a lower casing head body that is threaded or socket welded onto the upper end of a surface casing. This lower casing head body may carry a slip assembly or other means to support a production string that is concentrically disposed within the surface casing. One or more ports in the casing head body provide communication to the interior of the surface casing string. The casing string may extend downwardly into the wellbore for only a portion of the depth of the wellbore, although the production tubing string will typically extend downwardly to the desired depth in the wellbore. The top end of the production casing string may extend upwardly from the slip assembly in the casing head body and may be threaded at its upper end to another "independent screwed" wellhead body. In a similar manner, a tubular string may extend through this second wellhead body, supported by a second set of slips within the second wellhead body. A third wellhead body or tubing head may be "independently screwed" on top of this tubular string. Thus, additional strings of concentric tubulars may be utilized, and each string may have an independent wellhead body attached thereto.

Since the wellhead bodies, such as the tubing head body and casing head body, are generally not in physical contact with each other, they are classified as "independent". As well, the independent screwed casing head is not dependent upon the tubing head to seal off the annulus between the surface casing and the production tubing. A packing member may be provided above each slip assembly in a wellhead to selectively seal the annulus surrounding the tubing and in fluid communication with one or more side ports in the wellhead. Devices other than slips and packing members may be used for supporting a string of tubular goods and for sealing with the independent screwed wellhead body.

"Working pressure rating" means the highest pressure that the device is designed to withstand on a regular basis. The working pressure rating or capability of the independent screwed wellhead is relatively low, and typically is the range of about 3000 psi or less. This lower working pressure rating is sufficient to provide pressure control for many wells over their entire lifetime. Most importantly, the cost of the independent screwed wellhead is typically much lower than the cost of wellheads with flanges. For safety purposes, the working pressure capability of a wellhead will be greater than the pressure it is expected to handle.

The ranged casing head generally meets the standards of API Specification 6A or may have dimensionally compatible flanges meeting the requirements of the American National Standards Institute (ANSI). In a ranged wellhead, flanges disposed on the surface casing wellhead body and production tubing wellhead body are secured together. Because the flanges are in contact, they are not "independent". As well, it is necessary to secure the flanges together to form an annular seal. The ranged tubing head may have a lower recess or socket with a rubber seal therein that slides over the protruding tubular string until both flanges mate. The flanged casing head is therefore dependent upon the lower flange of the tubing head, and more specifically on the seal between the two flanges, to achieve a complete seal between the surface casing and the production casing. The ranged casing head and tubing head employ massive flanges, and therefore are significantly more expensive than the independent screwed wellheads.

The terms "tubing" and "casing" do not intrinsically describe a specific tubular member but more accurately reflect the purpose to which the tubular good is applied. As a very general rule, casing typically is a tubular with a nominal outside diameter of about 4½ inches or more. Tubing is typically a tubular with a nominal outside diameter of less than about 4½ inches. It will be understood herein that strings of "tubulars", "tubular goods", "tubular members", and the like may refer to various types of surface casing strings, production casing strings, and/or tubing strings.

A blowout preventer (BOP) is typically mounted on the wellhead, regardless of whether an independent screwed or ranged wellhead is utilized. The BOP is used during drilling and completion operations to control any pressure buildup that may occur in the well. The BOP is typically required as a safety precaution even when drilling and completing shallow, low pressure wells.

Most BOPs in use today have a massive API bottom flange designed to mate with the ranged casing head. An adapter flange, also known as a drilling flange, may be used to temporarily mate an independent screwed casing head with the bottom flange of a BOP. The production casing string and/or tubing string is typically run through the BOP. The BOP is conveniently installed above the casing head so that the casing or tubing hanger mechanism can be set while pressure in the annulus is controlled by the BOP.

Flanged wellheads were initially developed for high pressure operations, and are frequently designed for pressures in excess of 10,000 psi. Flanged wellheads commonly have at least a 5000 psi working pressure rating. A 5000 psi working pressure rating ranged wellhead may cost two to four times as much as a 3000 psi rated independent screwed wellhead. The well operator will therefore normally prefer utilizing an independent screwed wellhead unless it is anticipated that higher pressures will be encountered.

In many situations, operators anticipate encountering pressures above 3000 psi only-for a very short period of time. For instance, a well that requires a formation fracturing operation to complete the well will require high pressures for about one or two hours to break down or fracture a downhole formation. During the remainder of the life of the well, only relatively low pressures below 2000 psi may be anticipated. A lower working pressure independent screwed wellhead with a rating of 3000 psi would accordingly be suitable except for the short duration high pressure fracturing operation. Nevertheless, a high pressure flanged wellhead is typically used because of the high pressure associated with the temporary fracturing operation that may last only one or two hours. The massive flanged wellhead represents a substantial and costly over-design of the wellhead structure for the remainder of the life of the well.

In an attempt to resolve this problem, a prior art tubing head has been designed and sold by J. M. Huber Corporation that includes an independent screwed wellhead body that is lengthened to accept lockdown screws. The lockdown screws retain a special mandrel that isolates the wellhead body from the high pressures that are encountered during formation fracturing operations. Since the mandrel is designed to seal with the inside surface of the tubular, different mandrels are required for the same nominal size tubular having different interior diameters. This special mandrel may not always be commonly available at rig sites, especially in remote locations and for short notice. While this device has achieved some marketplace acceptance, most well operations use the more expensive flanged wellhead even when high pressures are only briefly encountered during a fracturing operation.

Consequently, there remains a need for a wellhead assembly that offers the option for high pressure operation, at least on a temporary basis, but at the reduced capital investment compared to the costs normally associated with higher working pressure flanged wellheads. Those skilled in the art have long sought and will appreciate the present invention which provides solutions to these and other problems.

SUMMARY OF THE INVENTION

The wellhead assembly of the present invention provides a low cost assembly for a well which normally requires a relatively low working pressure wellhead. The independent screwed wellhead assembly may be used in combination with a commonly available high strength casing or pipe nipple to effectively increase the working pressure rating of the wellhead for short time periods. The pipe nipple isolates the upper portion of the independent screwed wellhead body from the higher pressure required for a specific purpose, such as for formation fracturing operations performed prior to well completion. Thus, the high cost of a relatively high working pressure wellhead assembly, such as a ranged wellhead, is avoided.

For this purpose, a wellhead apparatus is disclosed that is operable for use with a blowout preventer for controlling pressure in a wellbore having therein at least one string of threaded tubulars. The wellhead apparatus comprises a body member having an internal bore therethrough for communication with the upper end of a string of threaded tubulars. A lower end of the body member is adapted for either a threaded connection or a socket welded connection to the upper end of the tubular string. A wall of the body member may have at least one port therethrough for communication with the internal bore, which port has a port axis transverse to the internal bore axis of the body member. An internal threaded section of the body member is disposed at a position along the internal bore between the lower threads on the body member and the at least one port, and is intended for structural and sealed mating with the casing or pipe nipple. The upper end for the body member may be adapted for connection to a blowout preventer.

The wellhead apparatus includes a body wall surrounding and below the internal threaded section, and this body wall has a thickness related to the desired temporary high pressure rating of the wellhead assembly. The body wall above the internal threaded section may have a thickness of approximately one-half the lower body wall, and thus has a much lower pressure rating.

A blowout preventer is provided above the wellhead assembly for controlling pressure in the wellbore. The blowout preventer has a blowout preventer bore therethrough having an axis substantially aligned with a tubular string axis. In operation, a first tubular string within the wellbore is connected to the lower end of the wellhead assembly. The method comprises the steps of moving a tubular member through the blowout preventer bore such that an end portion of the tubular member extends below the blowout preventer. The end portion of the tubular member is threadably sealed to the body member, such that fluid communication is prevented between the bore of tubular string and the exterior of the tubular member. Accordingly, the end portion of the tubular member is sealingly secured to the mating threads on the body member for isolating the upper portion of the wellhead body.

The tubular member may be installed for use during a well fracturing operation and then removed from the wellhead through the blowout preventer. A second tubular production string may be inserted into the bore of the first tubular string through the blowout preventer for the hydrocarbon recovery operation. The blowout preventer may then be removed and a standard wellhead cap may be installed to complete the well.

It is an object of the present invention to provide an improved wellhead apparatus. It is another object of the present, invention to provide a relatively low working pressure independent screwed wellhead with a temporary high working pressure capability.

A feature of the invention is a wellhead body with threads disposed along an internal bore of the wellhead body for receiving a high strength casing or pipe nipple for pressure isolation of the relatively weaker upper portion of the wellhead body. The casing or pipe nipple may be conveniently used during a brief formation fracturing operation. Another feature of the present invention is the increased wall thickness at a lower portion of an independent screwed wellhead body to accommodate higher pressures compared to the wall thickness in an upper portion of the same wellhead body. The threads for mating engagement with the pipe nipple are closely adjacent to the lower threads or socket weld connection which mate with the tubular string to reduce the height of the wellhead body.

An advantage of the present invention is the elimination of the need to purchase a more expensive and continually high working pressure flanged wellhead when higher pressure is required only for a short operation. During the remainder of the life of the well, a less expensive lower working pressure independent screwed wellhead is quite satisfactory. Another advantage of the invention is that commonly available components may be used to temporarily increase the working pressure of an independent screwed wellhead body.

These and other objects, features, and advantages of the present invention will become apparent from the drawings, the description given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1:
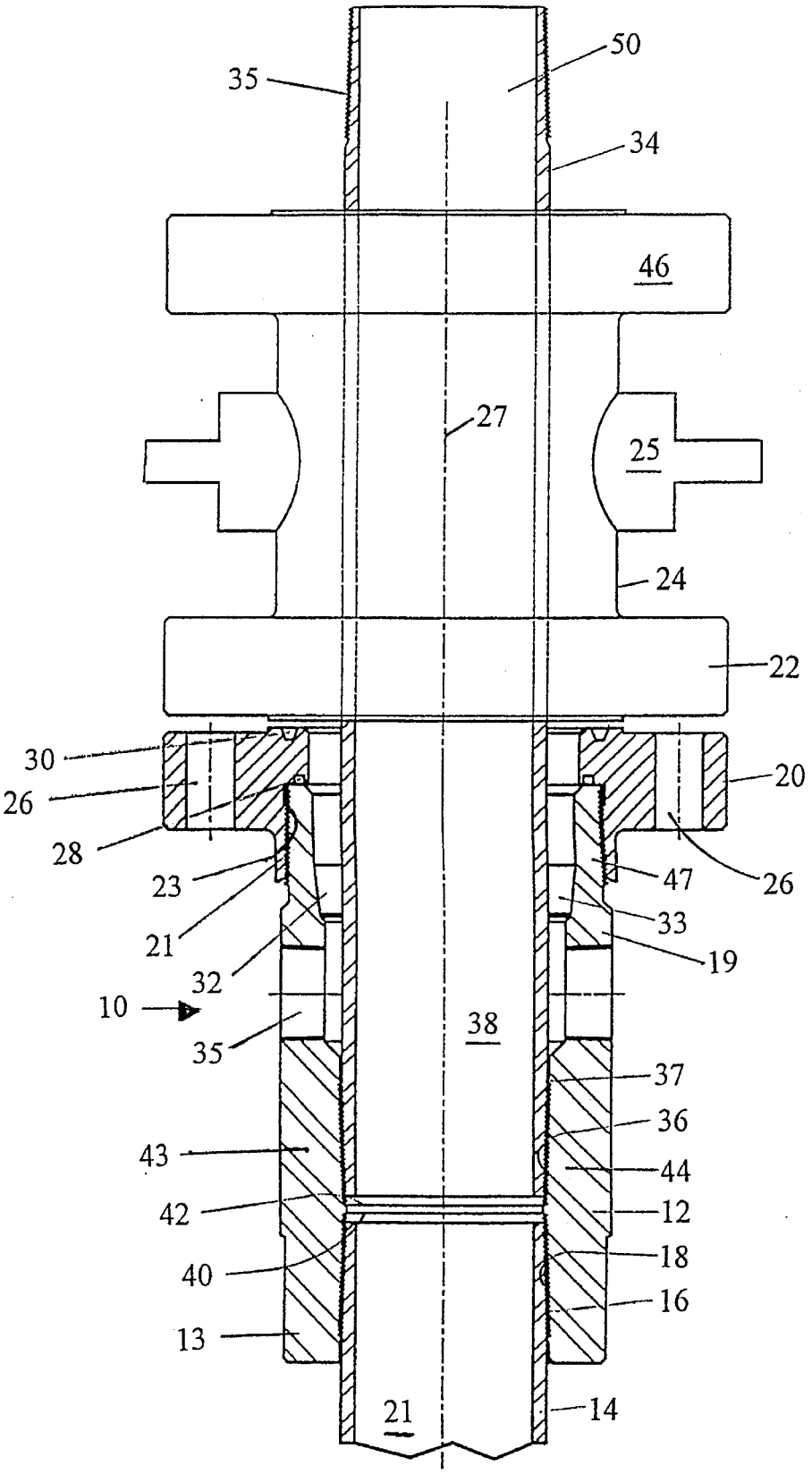
FIG. 1 is an elevational view, partially in section, of an independent screwed wellhead body and a high pressure casing nipple.

Referring now to the drawings, and more particularly to FIG. 1, the general configuration of well assembly 10 in accord with the present invention is illustrated. Wellhead body 12 is representative of an independent screwed wellhead in accord with the present invention.

FIG. 1 shows wellhead body 12 having a lower end 13 and an upper end 19. Lower end 13 and upper end 19 have different working pressure limitations as discussed hereinafter. Lower end 13 is sealingly secured to casing string 14 via a threaded interconnection between pin casing threads 16 on string 14 and mating box threads 18 on the lower end of body 12. Drilling flange 20 is mounted to the upper portion 19 of wellhead body 12 by upper wellhead body pin threads 21 that threadably engage internal drilling flange threads 23. Seal 28 forms a seal between drilling flange 20 and wellhead body 12 to prevent leakage through the threaded connection between drilling flange 20 and wellhead body 12.

Drilling flange 20 may be utilized to interconnect wellhead body 12 to blowout preventer (BOP) 24 that is schematically indicated in FIG. 1. Drilling flange 20 is coupled with lower BOP flange 22. For this purpose, bolts or other fasteners (not shown) may be inserted into circumferentially disposed bolt holes 26 for fastening lower BOP flange 22 with drilling flange 20. Seal 30 may be used to seal between drilling flange 20 and lower BOP flange 22 for sealing the annulus 32 within upper portion 19 of wellhead body 12.

Figure 2:
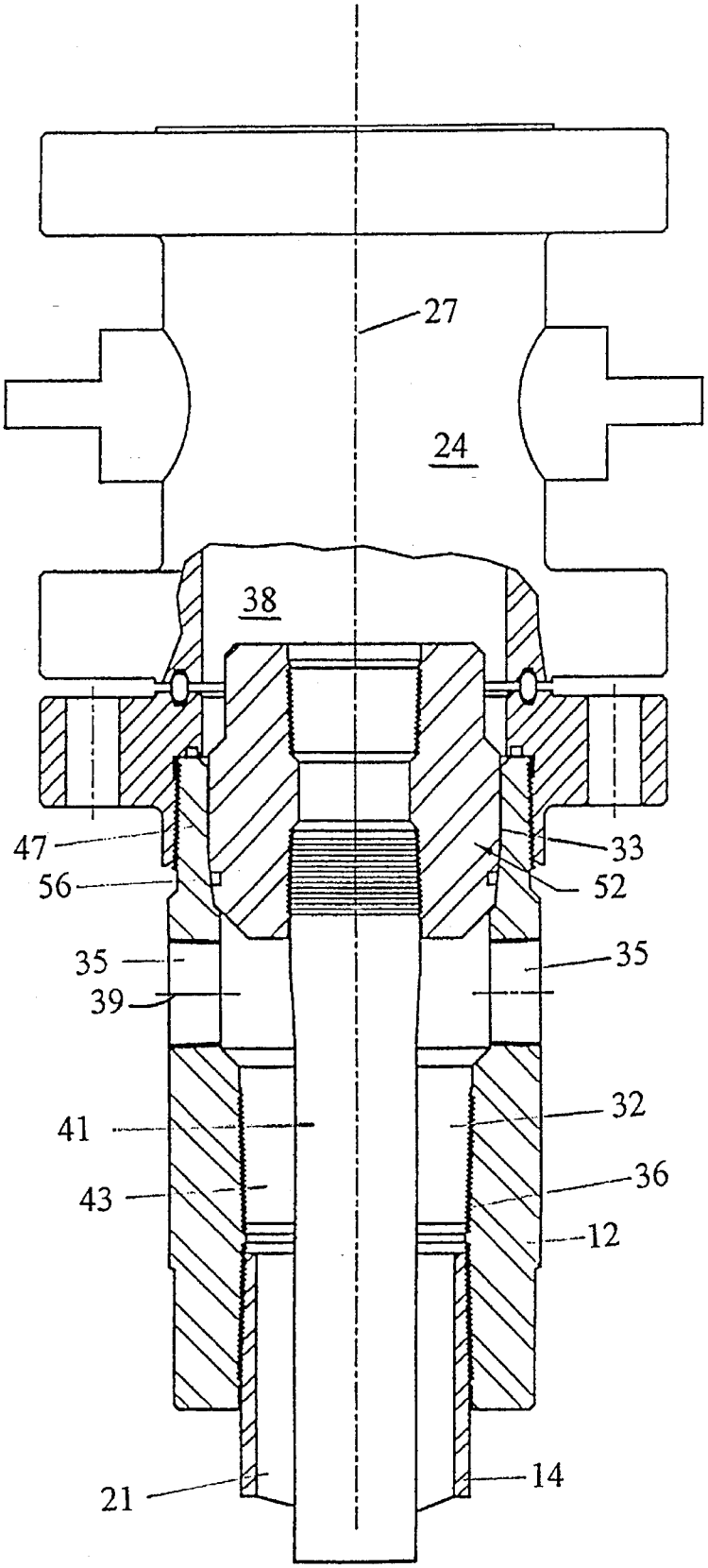
FIG. 2 is an elevational view, partially in section, of the independent screwed wellhead body as shown in FIG. 1 with the casing nipple removed and a tubing string positioned in the wellhead.
Figure 3:
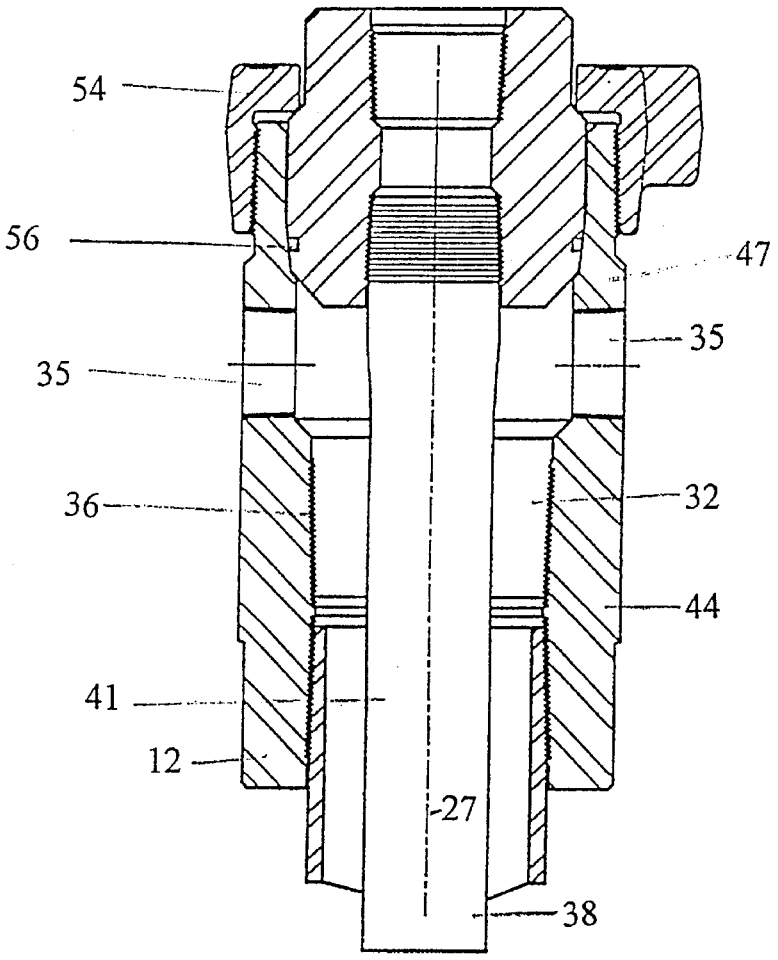
FIG. 3 is an elevational view, partially in section, of the independent screwed wellhead body as shown in FIG. 1 with the blowout preventer removed and replaced with a wellhead cap.

Upper end 19 of the body 12 has a bowl surface 33 that optionally may house slips (not shown) or other means to support another string of tubular goods, such as casing, positioned therein. In FIGS. 2 and 3, bowl surface 33 supports a mandrel support member 52. U.S. Pat. No. 5,028,079 for a Non-Crushing Wellhead, incorporated herein by reference, discloses an improved slip suspension assembly (not shown) that may be used within annulus 32 of a wellhead body according to this invention.

As indicated in FIGS. 2 and 3, opposing ports 35 in wellhead body 12 are typically provided to permit communication to the annulus 32 that is present between tubing 41 and production casing 14 in the completed well. Opposing ports 35 preferably each have an axis 39 that is transverse or perpendicular to axis 27 of bore 38.

Blowout preventer 24 is preferably used during drilling and completion operations to maintain pressure control over the well. Blowout preventer 24 is typically mounted above wellhead body 12 to allow continued pressure control by BOP 24 during the various operations performed on the well. Blowout preventer 24 typically includes closure members 25 for sealing purposes that move in a direction transverse or perpendicular to axis 27 of bore 38. After completion of the well, BOP 24 is preferably removed, as shown in FIG. 3, for use on another well. Wellhead body 12 will preferably remain as permanent part of the well.

FIG. 1 also discloses high pressure nipple 34, a high strength tubular member, that is used to allow high pressure operations, such as formation fracturing operations, to be performed with a relatively lower working pressure independent screwed wellhead 12. For illustrative purposes only, the formation fracturing operation may require surface pressures of around 6000 psi, while the pressure rating of wellhead 12 may be in the range of 3000 psi. For wells in which higher pressures are encountered only for very short periods of time, it is cost effective to temporarily boost the working pressure rating of the wellhead assembly rather than permanently install a wellhead having a working pressure rating of 6000 psi. Wellhead 12 may cost ¼ to ½ as much as a wellhead with a working pressure rating of 6000 psi.

Nipple 34 temporarily isolates the relatively lower working pressure upper end 19 of wellhead body 12 from the much higher pressure (typically in the range of 5500 psi) required for operations such as formation fracturing operations performed prior to well completion. Nipple 34 includes upper and lower threads 35 and 37, respectively. Upper thread 35 may be used for interconnection with, for example, a frack-line or frack-valve (not shown) used in formation fracturing operations. Lower thread 37 is secured to a middle section 43 of the wellhead body 12. Once the high pressure operation is completed, the high pressure nipple 34 may be removed to thereby leave the wellhead completely assembled for further conventional completion operations.

The present invention provides for lengthening a standard wellhead body by several inches to thereby permit machining of internal threads 36 adjacent to and opposing lower body threads 18. Internal threads 36 and lower body threads 18 are each formed along a portion of bore 38 extending through the length of wellhead body 12. Internal threads 36 are disposed between lower body threads 18 and upper threads 23. Preferably, threads 36 are disposed between lower body threads 18 and ports 35. The threads 36 are closely adjacent to threads 18 to limit the height of the wellhead body. The lower end of thread 36 is spaced axially from an upper end of the thread 18 less than 50%, and preferably less than 25%, of the nominal or average diameter of the threads 36.

The pin threads for the nipple 34 and mating internal box threads 36, and the pin threads 16 on the casing 14 and the mating box threads 18 on the body 12, are each typically slightly conical or tapered so that the outer diameter at thread end regions 40 and 42, respectively, increases to the full outer diameter of the tubular member while moving in a direction away from the respective end region. The apex for thread 36 is thus spaced substantially along axis 27 and below the body member 12, while the apex for thread 36 is spaced substantially along the same axis and above the body member. These tapered threaded connections provide both a reliable structural connection and a fluid tight seal between the connected members. If desired, a backup elastomeric seal could be used on these threaded connections. Such seals are well known in oilfield tubulars.

The minimal wall thickness of both the middle section 43 and the lower end 13 of wellhead 12, including specifically the entire portion below thread 36, is preferably increased relative to a standard independent screwed wellhead body. This wall 44 may have a thickness in the range of from about ½ to 2½ inches, depending on the application. The wall thickness of wall 44 of wellhead 12 is thus increased to handle a much higher pressure than that required for upper end 19. The increase in wall thickness adjacent threads 18 and 36 thus allows for the temporary reliable connection with the nipple 34 for high pressure operations. Due to the increase in wall thickness, lower end 13 has a working pressure capability that is about twice as much as the working pressure capability of upper end 19. Wall 47 that surrounds upper end 19 has a maximum thickness that may be about one-half the minimum thickness of the wall in the lower end 13. The lower end minimum wall thickness is at least 30% greater and typically at least 50% greater than the minimum thickness of the wall in the upper end 19.

If desired, a plastic or metallic thread protector may be provided to protect threads 36 prior to engagement with high pressure nipple 34. The thread protector may be designed to be easily inserted and/or removed as desired, and will have a suitable length for this purpose.

In operation, an integral high pressure nipple 34 is moved into well 21 such that the lower end 42 thereof extends through top flange 46, through BOP 24, past lower flange 22 and into wellhead body 12 where it is threadably secured. For this purpose, high pressure nipple 34 is rotated to physically secure lower end 42 within wellhead 12 and seal with threads 36. Thus, this threaded connection provides the seal as well as the mechanical support between the body 12 and the pressure nipple 34. The upper end 19 of the body member and the side ports 55 are thus isolated from the pressure within the nipple 34. Other sealing members may also be used for these purposes, if desired. The upper end 50 of high pressure nipple 34 may extend upward from the BOP 24 for connection to lines used for the high pressure operation. Since high pressure nipple 34 may have substantially the same bore size as casing string 14, the present invention may provide for full bore flow through wellhead 12 during the high pressure operation.

Once the formation is fractured or other high pressure operation is completed, the high pressure nipple 34 may be removed, as indicated in FIG. 2. For this purpose, counterclockwise rotation of nipple 34 will unscrew the threaded connection whereupon it is released for removal through the top of the BOP. Depending on the completion schedule, tubing 41 may then be run through BOP 24. Mandrel 52, a slip assembly, or other means may be used to support tubing 41 once it is positioned as desired within the well. A seal, such as seal 56, may be used to seal between the mandrel 52 and the body 12. The annulus 32 and the side ports 35 may thus be permanently sealed from the upper end of bore 38 above the mandrel 52, which remains in communication with the bore in tubing 41.

After the well is completed, BOP 24 is preferably removed and replaced with a standard 3000 psi working pressure cap 54, as shown in FIG. 3, that secures mandrel 52 in position. Conduits (not shown) may be attached to ports 35 and are typically used to receive production fluids.

Figure 4:
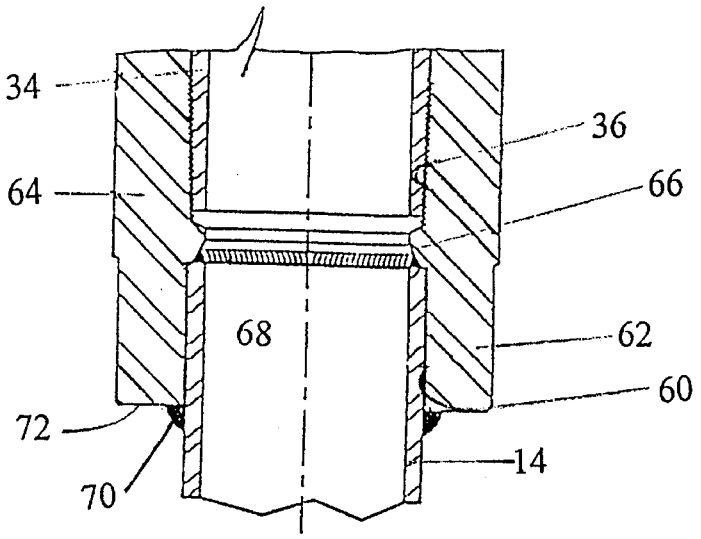
FIG. 4 is a cross-sectional elevational view of an alternate embodiment of an independent wellhead according to the invention with a socket weld connection to a tubular string.

FIG. 4 depicts the lower portion of an alternate embodiment of an independent screwed wellhead according to this invention, wherein the lower threads for connection to the upper end of the tubular string have been eliminated. For some applications, the pin threads on the upper end of the casing string 14 may be cut off, and a straight cylindrical recess or socket 60 provided within the lower end 62 of the wellhead body 64. An internal ring 66 may be provided on the body for serving as a stop for the upper end of the casing string 14, and for facilitating the fillet weld 68 with the end of the casing string, as depicted. Another fillet weld 70 is provided between the lower surface 72 of the body 64 and the exterior surface of the casing string 14.

The socket wellhead connection as shown in FIG. 4 thus replaces the threaded connection between the casing string and the wellhead body, and the wellhead body may otherwise be as described above. The uppermost end of the cut-off casing string 14 and the weld 68 are spaced axially from a lower end of the internal thread 36 less than 50%, and preferably less than 25%, of the nominal diameter of the threads 36 to limit the height of the wellhead body.

The operation of the present invention preferably uses threads for connecting the nipple with the lower end 13, with the nipple also isolating upper end 19. A casing nipple, such as nipple 34, is convenient since it has low cost and is universally available.

It will be understood that the foregoing disclosure and description of the invention is illustrative and explanatory thereof. It will be appreciated by those skilled in the art that various changes in the size, shape and materials, as well as in the details of the illustrated construction or combinations of features of the various elements, and in the described method, may be made without departing from the spirit of the invention.

What is claimed is:

1. A wellhead apparatus operable for use with a blowout preventer for controlling pressure within a wellbore, the wellbore having a tubular string disposed therein, the tubular string having an upper end, the wellhead apparatus comprising:

a body member having an internal bore therethrough with an internal bore axis for communication with the tubular string;

a lower end of the body member adapted for connection to the upper end of the tubular string;

a body wall of the body member having at least one port therethrough for communication with the internal bore; and an internal thread on the body member positioned along the internal bore axially between the lower end of the body member and the at least one port, the internal thread adapted for receiving a tubular nipple extending upward through the wellhead apparatus and the blowout preventer.

2. The wellhead apparatus as defined in claim 1, further comprising:

an upper end of the body member, the upper end of the body member being adapted for structural connection to the blowout preventer.

3. The wellhead apparatus as defined in claim 2, further comprising:

a wellhead adapter flange for ranged engagement with the blowout preventer; and the upper end of the body member including adapter flange threads for connection to the adapter flange.

4. The wellhead apparatus as defined in claim 1, wherein the upper end of the tubular string has an upper thread, and the lower end of the body member has a lower thread for connection to the upper thread on the tubular string.

5. The wellhead apparatus as defined in claim 4, wherein an upper end of the lower thread is spaced axially from a lower end of the internal thread less than 50% of a nominal diameter of the internal thread.

6. The wellhead apparatus as defined in claim 5, further comprising:

the lower thread on the body member is a box thread adapted for interconnection with a pin thread on the upper end of the tubular string; and an upper end of the lower thread is spaced axially from a lower end of the internal thread less than 25% of a nominal diameter of the internal thread.

7. The wellhead apparatus as defined in claim 1, wherein the lower end of the body member has a cylindrical recess for receiving the upper end of the tubular string and is welded to the upper end of the tubular string, and an uppermost end of the tubular string is spaced axially from a lower end of the internal thread less than 25% of a nominal diameter of the internal thread.

8. The wellhead apparatus as defined in claim 1, further comprising:

a tubular member having a threaded end, the tubular member extending through the blowout preventer for threaded engagement of the threaded end with the internal threads on the body member.

9. A wellhead apparatus for interconnection with a tubular string having a tubular bore axis, the tubular string having an upper end, the wellhead apparatus comprising:

a body member having an internal bore therethrough with an internal bore axis for communication with the tubular string, the internal bore axis being substantially concentric with the tubular bore axis;

a lower end of the body member adapted for sealed connection to the upper end of the tubular string;

an upper end of the body member, the upper end of said body member being adapted for housing a support member for sealingly supporting another tubular within the body member;

an internal threaded section of the body member having a tapered internal thread along the internal bore at a position axially between the lower end of the body member and the upper end of the body member, an apex of the tapered thread being spaced substantially along the internal bore axis and below the body member; and a tubular member having a threaded end, the tubular member extending through a blowout preventer for threaded engagement of the threaded end with the internal thread on the body member.

10. The wellhead apparatus as defined in claim 9, further comprising:

a body wall of the body member having at least one side port therethrough for communication with the internal bore, the at least one port having a port axis substantially transverse to the internal bore axis.

11. The wellhead apparatus as defined in claim 10, wherein:

the position of the internal thread along the internal bore being axially between the lower end of the body member and the at least one side port.

12. The wellhead apparatus as defined in claim 9, wherein the upper end of the tubular string has an upper thread, and the lower end of the body member has a lower thread for connection to the upper thread on the tubular string.

13. The wellhead apparatus as defined in claim 12, wherein an upper end of the lower thread is spaced axially from a lower end of the internal thread less than 50% of a nominal diameter of the internal thread.

14. The wellhead apparatus as defined in claim 9, wherein the lower end of the body member has a cylindrical recess for receiving the upper end of the tubular string and is welded to the upper end of the tubular string.

15. The wellhead apparatus as defined in claim 9, further comprising:

a tubular member having a threaded end, the tubular member extending through the blowout preventer for threaded engagement of the threaded end with the internal threads on the body member.

16. A method of supplying pressurized fluid to a tubular string supported within a wellbore by a wellhead, the pressure within the wellbore being controlled by a blowout preventer having a blowout preventer bore axis substantially concentric with an axis of the tubular string, the blowout preventer being supported above the wellhead, and the upper end of the tubular string being adapted for connection to a body member of the wellhead, the method comprising:

extending a tubular member through a blowout preventer bore such that an end portion is positioned below the blowout preventer and within the wellhead;

threadably connecting the tubular member to the body member of the wellhead while sealing a bore within the tubular string from an annulus between the body member of the wellhead and the tubular member; and pressurizing the tubular member to supply high pressure fluid to the tubular string.

17. The method as defined in claim 16, further comprising:

unthreading the tubular member from the body member of the wellhead; and removing the tubular member from the bore in the blowout preventer.

18. The method as defined in claim 17, further comprising:

thereafter removing the blowout preventer from the wellhead.

19. The method as defined in claim 16, further comprising:

isolating an upper end of the body member of the wellhead and a side port through the body member of the wellhead from fluid in the bore in the upper end of the body member.

20. The method as defined in claim 16, further comprising:

providing a lower thread on the body member for interconnection with the upper end of the tubular string.

* * * * *